US009042594B2

(12) United States Patent
Flavignard et al.

(10) Patent No.: US 9,042,594 B2
(45) Date of Patent: May 26, 2015

(54) ELECTRODYNAMIC TRANSDUCER HAVING A DOME AND AN INNER HANGING PART

(75) Inventors: Yoann Flavignard, Chartrettes (FR); Philippe Lesage, Chartrettes (FR)

(73) Assignee: PHL AUDIO, Chartrettes (FR)

( * ) Notice: Subject to any disclaimer, the term of this patent is extended or adjusted under 35 U.S.C. 154(b) by 0 days.

(21) Appl. No.: 13/522,250

(22) PCT Filed: Jan. 14, 2011

(86) PCT No.: PCT/FR2011/000024

§ 371 (c)(1), (2), (4) Date: Dec. 3, 2012

(87) PCT Pub. No.: WO2011/086301

PCT Pub. Date: Jul. 21, 2011

(65) Prior Publication Data

US 2013/0070954 A1 Mar. 21, 2013

(30) Foreign Application Priority Data

Jan. 15, 2010 (FR) ..... 10 00155

(51) Int. Cl.
*H04R 9/02* (2006.01)
*H04R 7/16* (2006.01)
(Continued)

(52) U.S. Cl.
CPC *H04R 7/16* (2013.01); *H04R 7/127* (2013.01); *H04R 9/043* (2013.01); *H04R 9/06* (2013.01);
(Continued)

(58) Field of Classification Search
CPC ..... H04R 7/00; H04R 7/04; H04R 7/16; H04R 7/18; H04R 7/20; H04R 7/22; H04R 7/24; H04R 9/00; H04R 9/04; H04R 9/043; H04R 9/045; H04R 31/003; H04R 31/006; H04R 2307/207
USPC ..... 381/150, 190, 342, 396, 398, 400, 405, 381/412, 416, 420, 430, 432
See application file for complete search history.

(56) References Cited

U.S. PATENT DOCUMENTS 1,631,646 A 6/1927 Rice
1,707,545 A 4/1929 Wente
(Continued)

FOREIGN PATENT DOCUMENTS

DE 102 07 561 C1 7/2003
DE 102 11 086 A1 10/2003
(Continued)

OTHER PUBLICATIONS

International Search Report for PCT/FR2011/000024 dated Apr. 20, 2011.
(Continued)

*Primary Examiner* — Ahmad F Matar
*Assistant Examiner* — Sabrina Diaz
(74) *Attorney, Agent, or Firm* — Sughrue Mion, PLLC

(57) ABSTRACT

Electro-dynamic transducer (1) including:
a main magnetic circuit (2) defining an air gap (15),
a moving part (16) comprising a dome shaped diaphragm (17) fixed to a movable coil (18) diving into the air gap (15);
a support (20) to which the moving part (16) is suspended;
a suspension (26) linking the moving part (16) and the support (20);
wherein the support (20) at least partly extends in an inner volume inside the moving part (16), wherein the suspension (26) is fixed, by an outer periphery, to an inner face of the moving part (16), and wherein the suspension (26) is made of an acoustically non emitting material.

18 Claims, 5 Drawing Sheets

(51) Int. Cl.

| | |
|---|---|
| ***H04R 9/04*** | (2006.01) |
| *H04R 7/12* | (2006.01) |
| *H04R 9/06* | (2006.01) |

(52) U.S. Cl.

CPC ..... *H04R 9/063* (2013.01); *H04R 2307/025* (2013.01); *H04R 2307/027* (2013.01); *H04R 2307/029* (2013.01)

(56) References Cited

U.S. PATENT DOCUMENTS

| | | | | | |
|---|---|---|---|---|---|
| 1,707,570 | A | | 4/1929 | Rice | |
| 1,766,473 | A | | 6/1930 | Wente | |
| 1,907,723 | A | | 5/1933 | Bostwick | |
| 1,930,915 | A | | 10/1933 | Wente | |
| 2,037,187 | A | | 4/1936 | Wente | |
| 2,269,284 | A | | 1/1942 | Olson | |
| 2,442,791 | A | | 6/1948 | Wente | |
| 2,490,466 | A | | 12/1949 | Olson et al. | |
| 3,006,430 | A | * | 10/1961 | Petrie et al. | 381/400 |
| 3,328,537 | A | | 6/1967 | Hecht | |
| 3,991,286 | A | | 11/1976 | Henricksen | |
| 4,164,631 | A | | 8/1979 | Garner et al. | |
| 4,256,930 | A | | 3/1981 | Garner et al. | |
| 4,283,606 | A | | 8/1981 | Buck | |
| 4,532,383 | A | | 7/1985 | Willy | |
| 4,933,975 | A | | 6/1990 | Button | |
| 4,965,839 | A | | 10/1990 | Elieli | |
| 5,018,206 | A | | 5/1991 | Suzuki | |
| 5,042,072 | A | | 8/1991 | Button | |
| 5,181,253 | A | | 1/1993 | Jordan | |
| 5,471,437 | A | * | 11/1995 | Schutter et al. | 367/175 |
| 5,475,765 | A | | 12/1995 | Lyth | |
| 5,548,657 | A | * | 8/1996 | Fincham | 381/182 |
| 5,602,930 | A | | 2/1997 | Walton | |
| 6,208,743 | B1 | * | 3/2001 | Marten et al. | 381/415 |
| 6,269,168 | B1 | | 7/2001 | Tagami | |
| 6,647,122 | B1 | | 11/2003 | Jones | |
| 6,792,125 | B1 | | 9/2004 | David et al. | |
| 6,922,477 | B1 | | 7/2005 | Ikeyama | |
| 6,963,650 | B2 | | 11/2005 | Combest | |
| 7,035,424 | B1 | | 4/2006 | Brandt | |
| 7,057,314 | B2 | | 6/2006 | Moro | |
| 8,073,186 | B2 | * | 12/2011 | Milot et al. | 381/398 |
| 2003/0051940 | A1 | | 3/2003 | Anthony et al. | |
| 2004/0086143 | A1 | * | 5/2004 | Espiritu | 381/398 |
| 2004/0202342 | A1 | | 10/2004 | Anthony et al. | |
| 2005/0069166 | A1 | | 3/2005 | Peng | |
| 2005/0254682 | A1 | | 11/2005 | Maekawa et al. | |
| 2006/0133637 | A1 | | 6/2006 | Proni | |
| 2006/0285705 | A1 | | 12/2006 | Kong | |
| 2007/0009133 | A1 | | 1/2007 | Gerkinsmeyer | |
| 2007/0201718 | A1 | | 8/2007 | Shimoe et al. | |
| 2008/0166010 | A1 | | 7/2008 | Stiles et al. | |

FOREIGN PATENT DOCUMENTS

| | | | |
|---|---|---|---|
| EP | 0 122 990 | A1 | 10/1984 |
| EP | 0 341 926 | A1 | 11/1989 |
| EP | 0 551 845 | A1 | 7/1993 |
| EP | 0 622 971 | A1 | 11/1994 |
| EP | 0 624 049 | A2 | 11/1994 |
| EP | 0 749 265 | A1 | 12/1996 |
| EP | 1 515 584 | A1 | 3/2005 |
| EP | 1 755 357 | A2 | 2/2007 |
| EP | 1 976 331 | A1 | 10/2008 |
| FR | 1001734 | A | 2/1952 |
| FR | 2 565 058 | A1 | 11/1985 |
| FR | 2 667 212 | A1 | 3/1992 |
| FR | 2 892 887 | A1 | 5/2007 |
| GB | 652378 | A | 4/1951 |
| GB | 701395 | A | 12/1953 |
| GB | 2 250 658 | A | 6/1992 |
| GB | 2 404 520 | A | 2/2005 |
| JP | 55-010217 | A | 1/1980 |
| JP | 60-253399 | A | 12/1985 |
| WO | 95/28065 | A1 | 10/1995 |
| WO | 99/30533 | A1 | 6/1999 |
| WO | 02/054826 | A1 | 7/2002 |
| WO | 2007/122386 | A1 | 11/2007 |
| WO | 2007/122390 | A1 | 11/2007 |
| WO | 2008/008034 | A1 | 1/2008 |

OTHER PUBLICATIONS

International Search Report of PCT/FR2011/000024, dated Apr. 20, 2011.

French Preliminary Search Report for FR 1000155, dated Aug. 8, 2010.

International Search Report of PCT/FR2011/000023, dated Apr. 20, 2011.

French Preliminary Search Report for FR 1000154, dated Aug. 5, 2010.

French Preliminary Search Report for FR 1000156, dated Aug. 5, 2010.

French Preliminary Search Report for FR 1000157, dated Aug. 6, 2010.

* cited by examiner

FIG.3
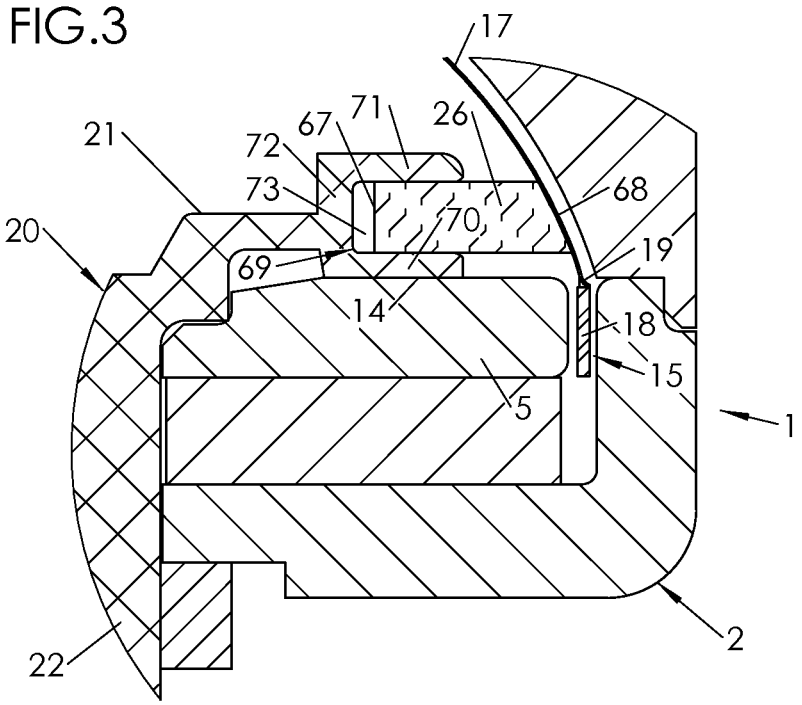
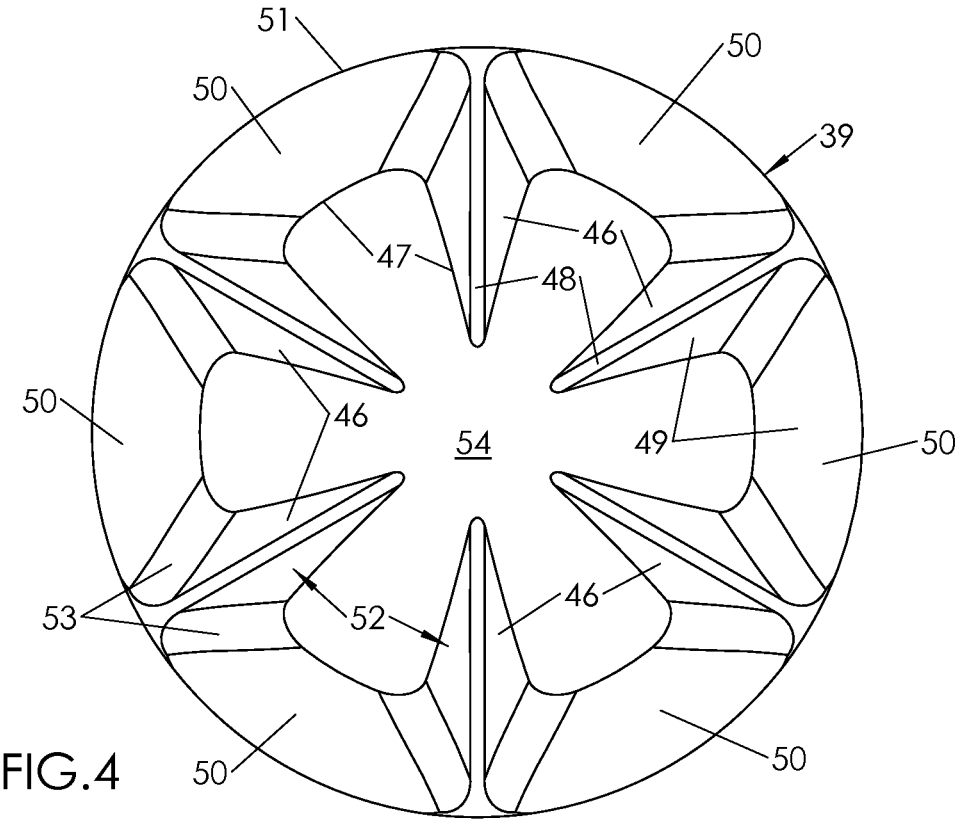
FIG.4

ELECTRODYNAMIC TRANSDUCER HAVING A DOME AND AN INNER HANGING PART

The invention generally relates to the field of sound reproduction by means of loudspeakers, also named electro-dynamic or electro-acoustic transducers, which convert an electrical energy generally delivered by an amplifier into acoustical energy.

Acoustical energy is radiated through a diaphragm the displacements of which induce variations of pressure of the ambient air, which propagate in space under the form of an acoustic wave.

In the Rice-Kellog type electro-dynamic transducer, which is the most common, the diaphragm is driven by a movable coil including a solenoid in which passes an electric current (from the amplifier) and which dives into an air gap filled with a magnetic field produced by a permanent magnet. Interaction between the electric current and the magnetic field induces a force known as the Laplace force driving the movable coil, which in turn drives the diaphragm, the vibrations of which produce an acoustic radiation.

Numerous designs were imagined for diaphragms; most common shapes are a cone (the generatrix of which may be straight or curved) and a dome, or a combination thereof.

In the case of the cone, the movable coil is generally fixed onto the edge of an opening formed in the center of the diaphragm. The size and mass of the moving part are somewhat important, reason for which such architecture is especially adapted to the manufacture of transducers designed for the reproduction of low range and mid range frequencies, requiring diaphragm vibrations of low frequency and great amplitude.

In the case of the dome, the movable coil is generally fixed to a peripheral edge of the diaphragm. The size and mass of the moving part may be minimize, reason for which such architecture is especially adapted to the manufacture of transducer designed to reproduce of high range, requiring diaphragm vibrations of high frequency and low amplitude.

Whichever its shape, the diaphragm is generally fixed to a chassis of the transducer trough a peripheral suspension which, in addition to its primary function of holding the diaphragm, has three general functions:

- Centering and axial guiding of the moving part (including the diaphragm and the movable coil) with respect of the air gap,
- Return effect to the diaphragm toward a rest position,
- Producing a secondary acoustic radiation which adds to the radiation of the diaphragm.

Centering and axially guiding the diaphragm is an important function of the diaphragm. Indeed, it is essential to exclude, or at least minimize, the transversal movements (swinging, pitch) of the diaphragm, which may generate distortions within the emitted sound signal.

The return function of the suspension, which acts onto the diaphragm as a spring, must be such calibrated that the resonance frequency be located at the beginning of the frequency bandwidth to reproduce. One may easily understand that, to reproduce high range frequencies, the diaphragm excursion should be low, and the suspension should be rather rigid.

In cone diaphragm transducers, the suspension, which has a large axial clearance, is generally not sufficient to guide the diaphragm with respect of the air gap. This is which complementary centering devices are generally provided, like of the spider type (Cf. French patent application FR 2 667 212 in the name of the applicant).

In the case of dome shaped diaphragms, the displacements of which are lower, the peripheral suspension is generally sufficient to efficiently ensure the three functions discussed hereinbefore. Such a topology has been known for a long time, Cf. U.S. Pat. No. 2,242,791 (Edward C. Wente/Bell Laboratories) of June 1948. A more recent example is exposed in US patent application No. US 2008/0166010 (Stiles et al).

However, a peripheral dome shaped suspension has several drawbacks.

A first drawback is the creation of interferences by the peripheral suspension (which is partly radiating, since it is driven by the displacement of the moving coil) with the main dome part of the diaphragm. This phenomenon is critical at high range frequencies, where one may witness, for several bandwidths, phase oppositions which are destructive as far as the sensitivity level is concerned. Practically, the response curve of the transducer shows hollows and peaks.

A second drawback is that part of the peripheral suspension is not radiating, since it is fixed by its peripheral edge to the transducer chassis. More precisely, the radiating surface of the peripheral suspension only represent 50% of the apparent surface, which reduces the overall emitting surface of the diaphragm by about one sixth (i.e. about 17%) with respect of its physical surface.

A third drawback is the important radial size of the transducer, which results from a great diaphragm diameter whereas only part thereof radiates. The radial size of the transducer increases when:

- the non radiating part of the peripheral suspension, which is necessary for fixing the dome, extends radially outside the latter and therefore occupies a peripheral space which cannot be used to generate sounds;
- fixation of the suspension requires a peripheral piece (exoskeleton) which increases even further the radial size;
- electric supply of the movable coil is achieved by means of wires which extend outside the diaphragm and require that the exoskeleton form a peripheral space sufficient for mounting the connecting terminals.

A fourth drawback is that the architecture of the diaphragm is not designed for evacuating the calories produced by Joule effect inside the movable coil. Indeed, in order to allow for the mounting of connecting terminals, the exoskeleton is generally made of an electrically and thermally insulating material.

Solutions were proposed to attempt to remedy to the performance defects of the high range transducers induced by the peripheral suspension. U.S. Pat. No. 5,471,437, for example, discloses a dome transducer in which an annular part of the diaphragm is received within the dome and is also part of an inner suspension of the dome.

This solution is apparently satisfactory but, although it may increase, with even size, the radiating surface of the transducer, it may however produce interferences in the same way as the peripheral suspension architecture disclosed hereinbefore. In addition, the architecture disclosed in U.S. Pat. No. 5,471,437 contributes to a tilting of the diaphragm (pitch effect), harmful to the good operation of the transducer.

The invention aims at proposing a solution to the problems disclosed hereinbefore, providing improvements to the dome diaphragms.

Therefore, the invention provides, in a first aspect, an electro-dynamic transducer including:

- a main magnetic circuit defining an air gap,
- a moving part comprising a dome shaped diaphragm fixed to a movable coil diving into the air gap;
- a support to which the moving part is suspended;
- a suspension linking the moving part and the support;

wherein the support at least partly extends in an inner volume inside the moving part, wherein the suspension is fixed, by an outer periphery, to an inner face of the moving part, and wherein the suspension is made of an acoustically non emitting material.

The use of a non emitting material for the manufacturing of the suspension allows for suppressing acoustical interferences between the suspension and the dome diaphragm.

Due to the fact that the suspension extends inside (instead of outside of) the diaphragm, the emitting surface represents up to 100% of the overall diaphragm diameter.

The suspension is preferably distant from an outer peripheral edge of the diaphragm and is shifted inwardly with respect thereof.

In one embodiment, the support comprises a plate on which the suspension is fixed, and a rod fixed to the plate and through which the support is fixed to the magnetic circuit.

In a first embodiment, the suspension comprises a planar inner portion fixed to the plate, and a peripheral portion surrounding the inner portion and which freely extends with respect of the plate and is fixed to the moving part through an outer peripheral edge.

In a second embodiment, the support comprises a peripheral groove, and the suspension, glued to the support, is under the form of a ring an inner edge of which is received within the groove.

The transducer may further comprise an electrical circuit for supplying the movable coil, including two electrical conductors which cross the magnetic circuit and open in the inner volume inside the diaphragm.

The plate may comprise a rim and a central disc provided with holes, a stripped end of each conductor being connected to one eye received within a hole.

The electrical circuit may comprise two resilient conductors which extend inside the inner volume of the diaphragm and connect each eye to an end of the movable coil.

In one embodiment, the transducer further comprises a waveguide mounted in the vicinity of the diaphragm and having a face facing and in the vicinity of the diaphragm and limiting a compression chamber.

The suspension is preferably made of a reticulated polymer foam, such as melamine foam.

In a second aspect, the invention provides a coaxial two-way or more loudspeaker system comprising a low range electro-dynamic transducer for the reproduction of low range and/or mid range frequencies, and an electro-dynamic transducer as disclosed hereinbefore, for the reproduction of high range frequencies and mounted in a coaxial and frontal position with respect of the low range transducer.

In a third aspect, the invention provides a loudspeaker enclosure including a transducer as disclosed hereinbefore or a coaxial loudspeaker system as disclosed hereabove.

The above and other objects and advantages of the invention will become apparent from the detailed description of preferred embodiments, considered in conjunction with the accompanying drawings in which:

FIG. 3 is a view similar to FIG. 2, in a second embodiment.

FIG. 4 is a top view of the high range transducer.

Figure 1:
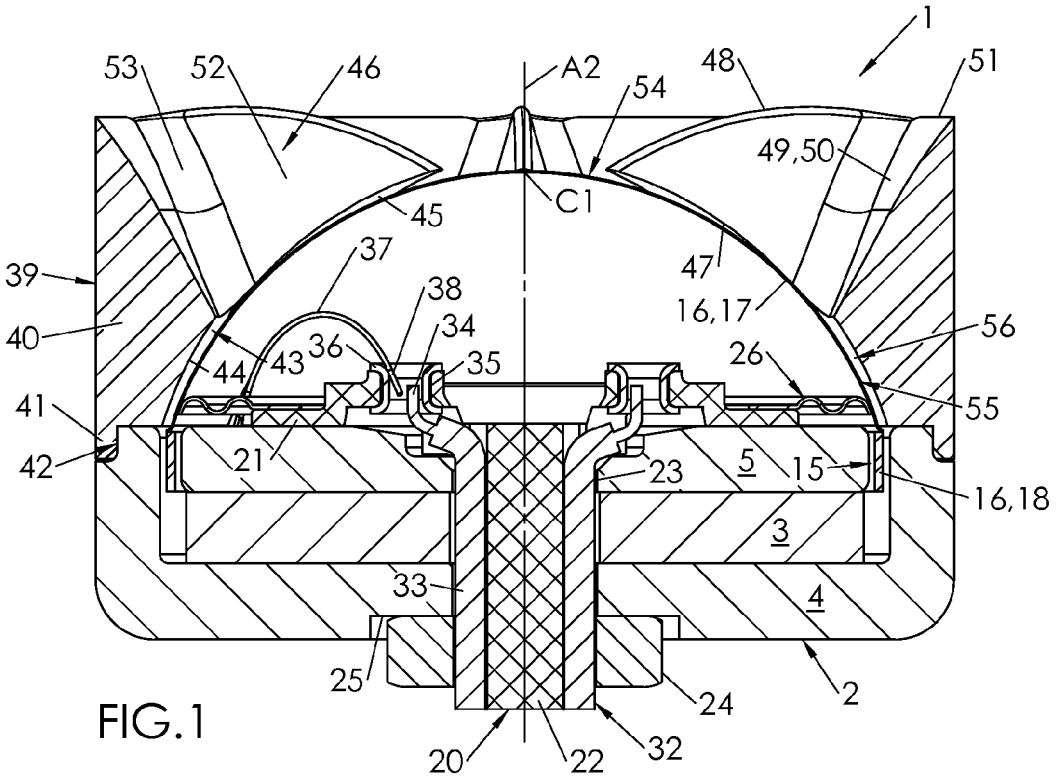
FIG. 1 is a sectional view showing a high range dome transducer in a first, preferred embodiment of the invention.

In FIG. 1-6, more precisely in FIG. 1 and FIG. 4 is illustrated an electro-dynamic transducer 1 adapted for reproducing high range frequencies, i.e. of about 1 kHz to 20 kHz.

The transducer 1 comprises a magnetic circuit 2 which includes a permanent central annular magnet 3, sandwiched between two pole pieces which form field plates, i.e. a back pole piece 4 and a front pole piece 5, glued on opposite face of the magnet 3.

The magnet 3 and the pole pieces 4, 5 have rotational symmetry around a common axis A2 forming the general axis of the transducer 1.

The magnet 3 is preferably made of a rare earth element neodymium iron boron alloy, which has the advantages of offering a high density of energy (up to 12 times higher than a permanent magnet of barium ferrite).

As depicted on FIG. 1, the back pole piece 4, called yoke, is of one piece and made of soft steel. It has a form of a cup with a U-shape diametral section, and has a bottom 6 fixed to a back face 7 of the magnet 3, and a peripheral side wall 8 extending axially from the bottom 6. The side wall 8 ends, at a front end opposite to the bottom 6, by an annular front face 9. The bottom 6 has a back face 10.

The front pole piece 5, called core, is also made of soft steel. It is of annular form and has a back face 12, by which it is fixed to a front face 13 of the magnet 3, and an opposite front face 14 which extends in the same plane as the front face 9 of the side wall 8 of the yoke 4.

As depicted on FIG. 1, the magnetic circuit 2 is extra-thin, i.e. its thickness is small with respect of its overall diameter. In addition, the magnetic circuit 2 extends up to the outer diameter of the transducer 1. In other words, the size of the magnetic circuit 2 is maximum with respect of the overall diameter of the transducer 1, which increases its power handling together with the value of the magnetic field, and hence the sensitivity of the transducer 1.

The core 5 has an overall diameter lower than the inner diameter of the side wall 8 of the yoke 4, so that between the core 5 and the side wall 8 is defined a secondary air gap 15 in which is concentrated most part of the magnetic field generated by the magnet 3.

In the air gap 15, the edges of the core 5 and of the yoke 4 may be chamfered, or preferably (and as depicted on FIG. 1), rounded so as to avoid harmful burrs.

The transducer 1 also comprises a moving part 16 including a dome shaped diaphragm 17 and a movable coil 18 fixed to the diaphragm 17.

The diaphragm 17 is made of a light and rigid material, a thermoplastic polymer or an aluminum-based alloy, magnesium or titanium. The diaphragm 17 is such positioned as to cover the magnetic circuit 2 on the side of the core 5, and such that its axis of rotational symmetry be merged with the axis A2.

Hence, the apex of the diaphragm 17, located on the axis A2, may be regarded as the acoustical center C2 thereof, i.e. the equivalent punctual source from which the transducer 1 acoustically radiates.

The diaphragm 17 has a circular peripheral edge 19 which is slightly turned up, in order to facilitate the fixing of the movable coil 18.

The movable coil 18 comprises a conductive metal (e.g. copper or aluminum) wire solenoid, spiral winded to form a cylinder, an upper end of which is glued to the turned-up peripheral edge 19 of the diaphragm 17. Here, the coil 18 has no support (but could have one).

The movable coil 18 dives in the air gap 15, which it is advantageous to fill with a mineral oil loaded with magnetic particles, such as of the type sold by FERROTEC under trade name Ferrofluid™. Such a filling has the following advantages:

- it contributes to the centering of the movable coil 18 within the air gap 15,
- it functions as a dynamic lubricant, and therefore contributes to the silent operation of the transducer 1;
- its thermal conductivity, which is far higher than the thermal conductivity of air, contributes to the evacuation, toward the magnetic circuit 2 (and more specifically toward the yoke 4), of the heat produced by Joule effect within the movable coil 18.

The transducer 1 further comprises a support 20 fixed to the magnetic circuit 2 and to which the moving part 16 is suspended. The support 20, which is made of a diamagnetic and electrically insulating material, for example a thermoplastic material such as polyamide or polyoxymethylen (charged with glass or not), has a general shape of rotational symmetry around an axis merged with the axis A2, and has a T-shaped section.

The one-piece support 20 forms an endoskeleton for the transducer 1 and includes an annular plate 21 contacting the front face 14 of the core 5, and a cylindrical rod 22 which protrudes backwards from the center of the plate 21, and which is located in a complementary cylindrical recess 23 formed within the magnetic 2 circuit and formed by a succession of coaxial drillings made in the yoke 4, the magnet 3 and the core 5 which together ensure the centering of the support 20 with respect of the magnetic circuit 2.

As depicted on FIG. 1, the endoskeleton 20 is rigidly fixed to the magnetic circuit 2 by means of a nut 24 screwed onto a threaded section of the rod 22 and tightened against the yoke 4, within a counterbore 25 formed in the back face 10, at its center. Thereby, the plate 21 is tightly urged against the front face 14 of the core 5, without rotational possibility. This fixing may be completed by a glue film between the plate 21 and the core 5.

Given its frontal situation with respect of the magnetic circuit 2, the plate 21 extends within the lenticular inner volume limited by the diaphragm 17.

The moving part 16 is mounted onto the endoskeleton 20 by means of an inner suspension 26 which connects the diaphragm 17 and the plate 21. This suspension 26 has a rotational symmetry and is made of a light, elastic, acoustically non emissive material (the material may be porous). This material is preferably resistant to heat within the transducer, and its elasticity is chosen so that the resonance frequency of the moving part 16 be lower than the lowest frequency reproduced by the transducer 1 (i.e. 500 Hz to 2 kHz).

Figure 2:
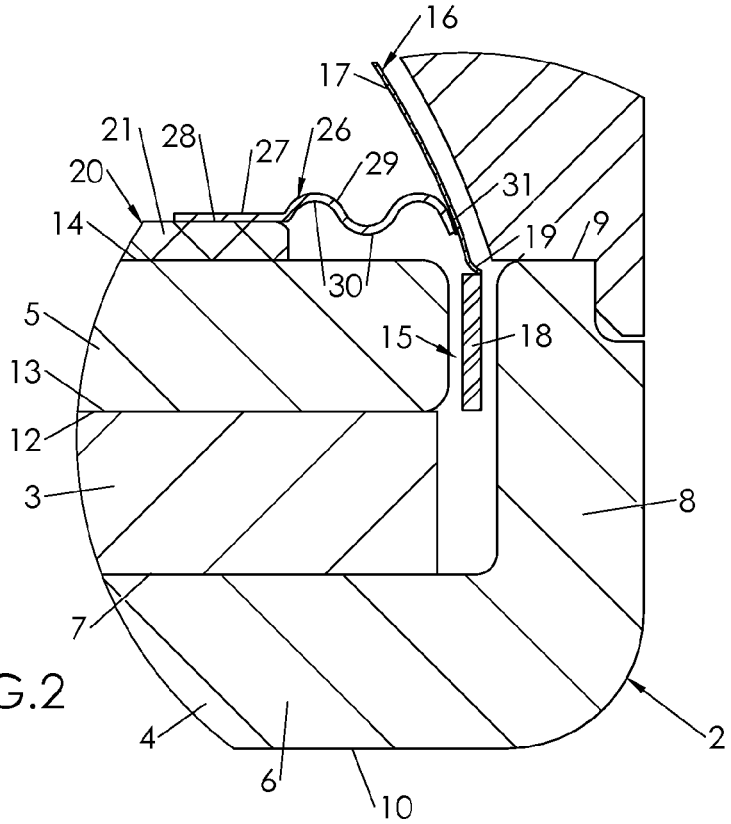
FIG. 2 is a sectional view of a detail of FIG. 1.

In a first preferred embodiment illustrated on FIG. 1 and FIG. 2 the suspension 26 is of the "spider" type and is made in a fabric of natural fibers (such as cotton) or synthetic fibers (such as polyester, polyacrylic, Nylon™, and more specifically aramides such as Kevlar™), or in a mixture of natural and synthetic fibers (such as cotton-polyester), wherein the fibers are impregnated with a thermosetting or thermoplastic resin, which gives strength, stiffness and elasticity to the suspension 26.

The suspension includes an inner annular, planar portion 27, glued to an upper face 28 of the plate 21, and a peripheral section 29 which extends around the inner portion 27. The peripheral portion 29 freely extends radially outside from the plate 21 and comprises corrugations 30 which may be thermoformed.

The suspension 26 has an outer edge 31 through which it is glued to the inner surface of the diaphragm 17, in the vicinity of the peripheral edge 19 thereof. Alternately, in case the movable coil 18 includes a cylindrical support fixed to the diaphragm 17 and onto which the solenoid is mounted, the suspension 26 may be fixed, through its outer edge, onto the inner surface of such support.

One may note that the moving part 16 should be perfectly centered with respect of the magnetic circuit 2, and more precisely with respect of the air gap 15 in which the movable coil 18 is located. To this end, a centering assembling tool (false yoke) is used, in which the endoskeleton 20 is positioned. The centering assembling tool comprises a bore (the diameter of which is equal to the diameter of the recess 23) in which the rod 22 of the endoskeleton 20 is inserted. The suspension 26 is then glued onto the plate 21. Before the glue becomes sticky, the inner diameter of the moving coil 18 is centered with respect of the bore of the mounting assembly, which ensures the centering of the moving part 16 with respect of the endoskeleton 20. After the glue has become sticky, the assembly comprising the moving part 16 and the endoskeleton 20 may then be mounted in a perfectly centered way within the magnetic circuit 2.

The suspension 26 provides a return function to the moving part 16 toward an intermediate rest position, in which the moving part 16 stands in the absence of any axial constraint on the movable coil 18 (i.e., practically, in the absence of an electrical current theretrough). It is in this intermediate position that the transducer 1 is illustrated in the drawings.

The suspension 26 also provides a function of maintaining the trim of the diaphragm 17, i.e. of maintaining the peripheral edge 19 of the diaphragm 17 in a plane perpendicular to the axis A2, in order to avoid tilting (or pitch) of the diaphragm 17 which would affect its good operation.

The electric current is provided to the movable coil 18 by two electrical circuits 32 which link the ends of the movable coil 18 to two feeding electrical terminals (not illustrated).

As depicted in FIG. 1, each electrical circuit 32 comprises:

- an electrical conductor 33 of great diameter, including a copper wire insulated with a plastic jacket, extending through the magnetic circuit 2 and located within a slot formed longitudinally within the rod 22 of the endoskeleton 20, and a stripped front end 34 of which opens in the inner volume of the diaphragm 17 and protrudes from the magnetic circuit 2 in a hole 35 formed in the plate 21;
- an electrical connection element under the form of a metal eye 36 (made of copper or brass) crimped within the hole 35 and to which the stripped end 34 of the conductor 33 is electrically linked (for example by means of a welding point, not illustrated);
- a conductor 37 of small diameter, under the form of a resilient metallic braid suitably formed, which extends within the internal volume of the diaphragm 17 and extending over the plate 21 and the suspension 26, an inner end 38 of which is electrically connected to the eye 36 (for example by means of a welding point, not illustrated), and an opposite outer end of which is electrically connected to an end of the movable coil 18.

Only one conductor 37 of small diameter is visible on FIG. 1. The second one, which is diametrically opposite to the latter, is located in front of the section plane of the figure.

Due to their arcuate form (U-shape of the conductors 37, and to their great resilience, the conductors may deform easily and follow the movements of the diaphragm 17 which accompany the vibrations of the movable coil 18, without adding any radial or axial constraint which might compromise the positioning of the moving part 16 with respect of the air gap 15.

The transducer 1 comprises an acoustical waveguide 39, fixed to the magnetic circuit 2.

The waveguide 39 is one piece and is made of a material having a high thermal conductivity, higher than 50 $W \cdot m^{-1} \cdot K^{-1}$, such as in aluminum (or an aluminum alloy).

The waveguide 39 has a rotational symmetry, is directly fixed to the yoke 4 and comprises a substantially cylindrical outer side wall 40 which extends flush with the side wall 8 of the yoke 4. The waveguide is preferably screwed, by means of at least three screws. In order to maximize thermal contact between both pieces, it is advantageous to complete the screwing by applying a heat conducting paste.

As depicted on FIG. 1 and FIG. 2, the waveguide 39 has, on a back peripheral edge, a skirt 41 which adjusts on a shoulder 42 made in the yoke 4, of complementary shape, whereby a precise centering of the waveguide 39 with respect of the yoke 4, and more generally with respect of the magnetic circuit 2 and the diaphragm 17, is provided. In addition, thermal conductivity between both pieces 4, 39 is enhanced.

The waveguide 39 has a back face 43 shaped like a substantially spherical cap, which extends in a concentric way with respect of the diaphragm 17, facing and in the vicinity of an outer face thereof, which the back face 43 partly covers.

In an embodiment depicted in FIG. 1, the back face 43 is provided with openings and comprises a continuous peripheral portion 44 which extends in the vicinity of the back edge of the waveguide 39, and a discontinuous central portion 45 carried by a series of wings 46 which radially protrude inwardly (i.e. towards the axis A2 of the transducer 1) from the side wall 40. The back face 43 is limited inwardly—i.e. on the diaphragm side—by a petaloid shaped edge 47 (clearly visible on FIG. 4).

As depicted on FIG. 1, the wings 46 do not meet at the axis A2 but are interrupted at an inner end located at a distance from axis A2. At its apex, each wing has a curved edge 48.

The side wall 40 of the waveguide 39 is limited inwardly by a discontinuous frusto-conical front face 49 divided into a plurality of angular sectors 50 which extend between the wings 46. This front face 49 forms a horn initial section extending from the inside to the outside and from a back edge, formed by the petaloid edge 47 which forms a throat of the horn initial section 49 up to a front edge 51 which forms a mouth of the horn initial section 49. The angular sectors 50 of the horn initial section 49 are portions of a cone with rotational symmetry the axis of which is merged with the axis A2, and the generatrix of which is curved (for example following a circular, exponential or hyperbolic law). The horn initial section 49 ensures a continuous acoustical impedance adjustment between the air environment limited by the throat 47 and the air environment limited by the mouth 51.

In an embodiment, the tangent to the horn initial section 49 on the mouth 51 forms, together with a plane perpendicular to the axis A2 of the transducer 1, an angle comprised between 30° and 70°. In the depicted example, this angle is of about 50°.

Each wing 46, one function of which is to increase the exchange surface of the waveguide 39 to contribute to dissipation and convection of heat produced by the movable coil 18, has two side flanges 52 which outwardly connect to the angular sectors 50 of the horn initial section 49 through fillets 53. The side flanges 52 contribute to guiding the wave generated by the diaphragm 17.

Figure 6:
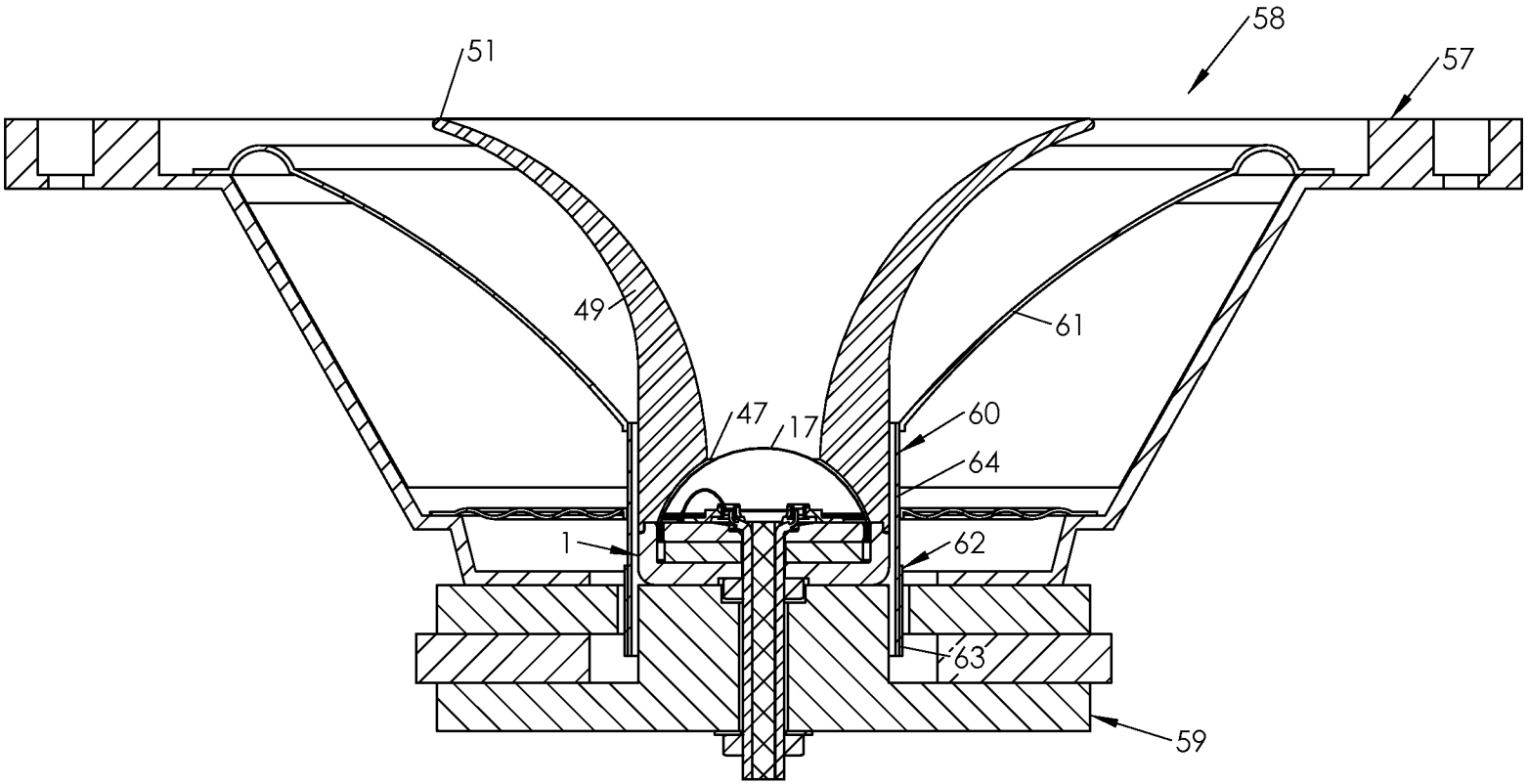
FIG. 6 is a view similar to FIG. 5, showing a coaxial loudspeaker system comprising a low range transducer, and a high range transducer in an alternate embodiment in which the high range transducer includes a horn.

In an alternate embodiment depicted on FIG. 6, the waveguide 39 does not form a horn initial section but a whole horn (which may be of rotational symmetry around the axis A2), the throat 47 of which is of circular shape and the mouth 51 of which has a diameter far greater than the diameter of the throat 47.

The waveguide 39 limits on the diaphragm 17 two distinct and complementary zones, namely:

- an uncovered outer zone 54, of petaloid shape, outwardly limited by the throat 47,
- a covered outer zone 55, the shape of which is complementary to the covered zone 54, inwardly limited by the throat 47.

The back face 43 of the waveguide 39 and the corresponding covered outer zone 55 of the diaphragm 17 together define an air volume 56 called compression chamber, in which the acoustical radiation of the vibrating diaphragm 17 driven by the coil 18 moving in the air gap 15 is not free, but compressed. The uncovered inner zone 54 directly connects to the facing throat 47, which concentrates acoustical radiation of the whole diaphragm 17.

The compression rate of the transducer 1 is defined by the ratio of the emitting surface, corresponding to the planar surface limited by the overall diameter of the diaphragm 17 (measured on the edge 19) and the surface limited by the projection, in a plane perpendicular to the axis A2, of the throat 47. This compression rate is preferably higher than 1.2:1, and for example equal or greater than 1.4:1. Higher compression rates, for example up to 4:1, are possible.

A second embodiment, illustrated in FIG. 3, differs from the first embodiment disclosed hereinbefore by the design of the suspension 26 and the shape of the endoskeleton 20.

Indeed, the suspension 26 has in section a substantially polygonal shape and has an straight inner edge 67, i.e. with rotational symmetry around the axis A2, and an outer peripheral edge 68 of frusto-conical shape.

The plate 21 has substantially the shape of a pulley and comprises a peripheral annular groove 69 which radially opens inwards, facing an the inner surface of the diaphragm 17, in the vicinity of the edge 19.

The groove 69 separates the plate 21 in two flanges facing each other, which form the side walls of the groove 69, namely a back flange 70, which contacts the front face 14 of the core 5, and a front flange 71. Both flanges 70, 71 are connected through a cylindrical web 72 forming the bottom of the groove 69.

On the side of its inner edge 67, the suspension 26 is located within the groove 69 (with a slight compression) and is glued to the flanges 70, 71, during the assembly of the moving part 16 in the manner disclosed previously in the first embodiment. To this end, a radial clearance 73 is provided between the internal edge 67 of the suspension 26 and the bottom of the groove 69.

Through its outer frusto-conical edge 68, suspension 26 is fixed to the inner face of the diaphragm 17, in the vicinity of the outer edge 19 thereof.

The suspension 26 may be realized in an acoustically non-emitting materials already disclosed, or in a reticulated polymer foam (such as polyester or melamine) which is advantageously non emissive and has the advantage of being non emitting and of being highly porous and heat resistant.

Figure 5:
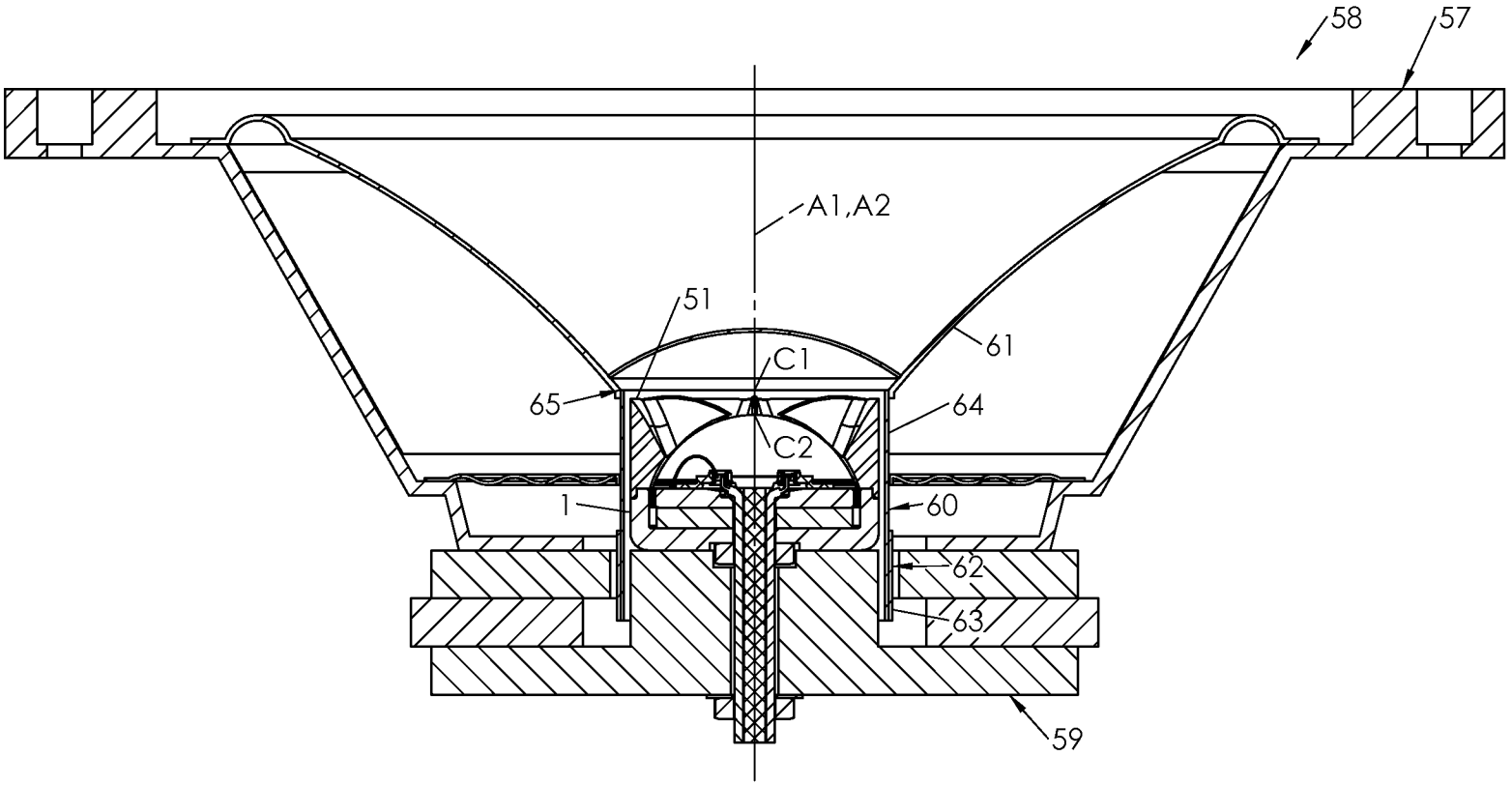
FIG. 5 is a sectional view showing a coaxial loudspeaker system comprising a low range transducer, and the high range transducer of FIG. 1 mounted therein in a coaxial and frontal position.

The high range transducer 1 disclosed hereinbefore may be used individually or, as depicted in FIG. 5-6, coupled to a low range transducer 57 for forming a several-way loudspeaker system 58 designed to cover a large acoustical spectrum, ideally the whole audio bandwidth.

Practically, the low range transducer 57 may be designed to reproduce the low range and/or the mid range, and possibly part of the high range. To this end its diameter shall preferably be comprised between 10 cm and 38 cm. Although the main object of the present invention does not include the definition of parameters regarding the spectrum covered by the different transducers of the system 58, it shall be however noted that the spectrum of the low range transducer 57 may cover the lower range, i.e. the range of 20 Hz-200 Hz, or the mid-range, i.e. the rage of 200 Hz-200 Hz, or even at least part of the mid-range and low range (and for example the whole low range and mid-range) and possibly part of the high range. As an example, the low range transducer 57 may be designed to cover a bandwidth of 20 Hz-1 kHz, or 20 Hz-2 kHz, or even 20 Hz-4 kHz.

The high range transducer 1 is preferably designed so that its pass band is at least complementary to the low range transducer 57 in high range. One may therefore ensure that the pass band of the high range transducer 1 covers at least part of the mid-range and the whole high range, up to 20 kHz.

It is preferable that the linear responses of the transducer 1, 57 at least partly cross, and that the sensitivity level of the high range transducer 1 be at least equal to that of the low range transducer 57, in order to avoid a decrease of the global response of the system 57 at certain frequencies corresponding to the higher part of the spectrum of the low range transducer 57 and to the lower part of the spectrum of the high range transducer 1.

The low range transducer 57 is of classical architecture and it shall not be disclosed in detail. However, it shall be noted that the low range transducer 57 comprises a magnetic circuit 59 having a rotational symmetry around an axis A1 which forms the general axis of the low range transducer 57.

The low range transducer 57 also comprises a moving part 60 including a diaphragm 61 which is conical with a rotational symmetry around axis A1 (with a curved generatrix, such as a circular, exponential or hyperbolic law), and a movable coil 62 including a solenoid 63 winded around a cylindrical support 64 fixed to the diaphragm 61.

In its center, the diaphragm 61 defines an opening 65 on the inner edge of which the support 64 is glued by a front end thereof. The geometrical center of the opening 65 is considered, in first approximation, as the acoustical center C1 of the low range transducer 57, i.e. the equivalent punctual source from which the acoustical radiation of the low range transducer 57 is generated.

As depicted on FIG. 5 and FIG. 6, the high range transducer 1 is located within the low range transducer 57 and is received within a central frontal space (i.e. on the front side of the magnetic circuit 59), limited backwards by the magnetic circuit 59, and laterally by the inner wall of the support 64.

As depicted on FIG. 5 and FIG. 6, the high range transducer 1 may be mounted within the low range transducer 57 both:

- In a coaxial way, i.e. the axis A1 of the low range transducer 57 and the axis A2 of the high range transducer 1 are merged,
- In a frontal way, i.e. the transducer 1 is positioned in the front of the magnetic circuit 59 (i.e. on the side of the magnetic circuit 59 where the diaphragm 61 is located).

This so-called "frontal" assembly, which is opposite to the rear assembly in which the transducer is mounted on the back face of the yoke (cf. e.g. U.S. Pat. No. 4,164,631 to Tannoy) is made possible due to the specific architecture of the high range transducer 1.

In addition to the coaxial frontal positioning of the transducer 1 with respect of the low range transducer 57, their respective geometries, the thickness of the magnetic circuits 2, 59 and the curvature (and hence the depth) of the diaphragm 61, are preferably adapted to permit at least an approximate coincidence of the acoustic centers C1, C2 of the transducers 1, 57, such that the time offset between the acoustical radiation of the transducer 1, 57 be unperceivable (this situation is called time alignment of the transducers 1, 57). The system 58 may then be regarded as perfectly coherent despite duality of the sound sources.

In addition, in the embodiment depicted on FIG. 5, the axial positioning of the high range transducer 1 with respect of the low range transducer 57, together with the geometry of the waveguide 39, are such that the diaphragm 61 is aligned with the horn initial section 49. In other words, the tangent to the horn initial section 49 on the mouth 51 merges with the tangent to the diaphragm 61 at its central opening 65. In such a configuration, the waveguide 39 and the diaphragm 61 of the low range transducer 57 together form a complete horn for the secondary transducer 1, permitting both transducers 1, 57 to have homogeneous directivities.

In the alternate embodiment of FIG. 6, the waveguide 39 forming a whole horn is independent from the diaphragm 61 of the low range transducer 57. In such configuration, the directivities of the transducers 1, 57 are distinct and may be optimized separately, which is advantageous in some applications, such as stage monitor speakers.

Figure 7:
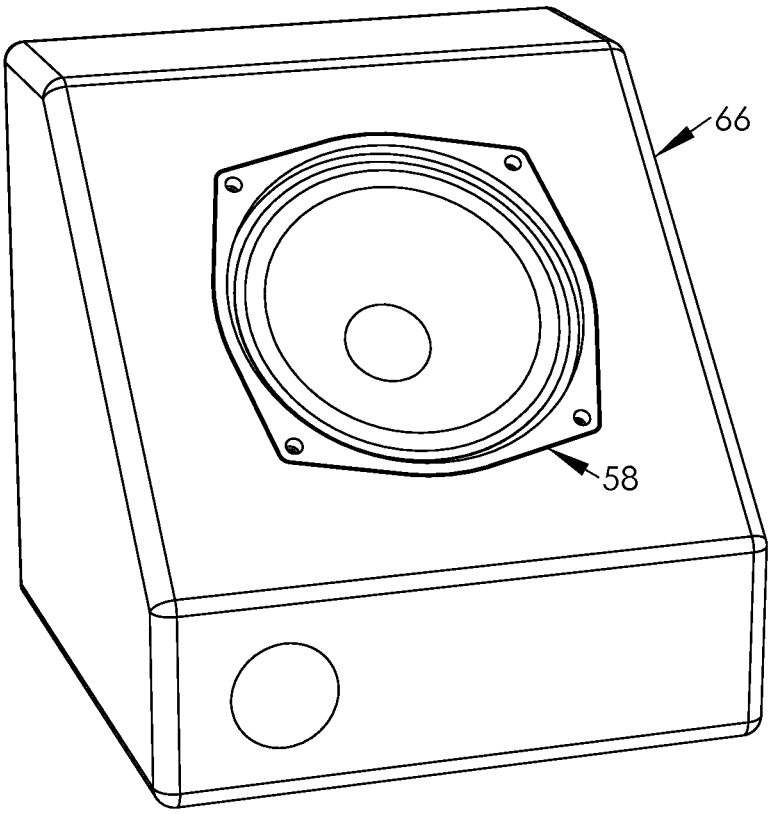
FIG. 7 is a perspective view showing a loudspeaker enclosure including a coaxial loudspeaker system as illustrated on FIG. 5.

The system 58 may be mounted on any type of loudspeaker enclosure, such a stage monitor loudspeaker 66, with an inclined front face, as in the depicted example of FIG. 7.

The architecture of the transducer 1 disclosed hereinbefore, combined with acoustical properties of the suspension 26, provide the following advantages.

Firstly, the situation of the suspension 26 inside the dome diaphragm 17 and the manufacturing of the suspension 26 in an acoustically non-emitting material suppresses acoustical interferences between suspension 26 and diaphragm 17.

Secondly, the fact that suspension 26 extends inside the diaphragm 17 instead of outside of it allows for increasing the emitting surface up to 100% of the overall diameter of the diaphragm 17.

This increase of the emitting surface of the diaphragm 17 allows for a substantial gain in terms of sensitivity of the transducer 1, since this gain is proportional to the square of the emitting surface. Practically, the architecture of the transducer 1 allows, considering the overall diameter of the transducer equal, for an increase of the emitting surface up to 17%. Therefore, the gain in sensitivity is of about 1.4 dB.

Thirdly, due to the absence of suspension outside the diaphragm 17, the diameter of the movable coil 18 may be increased, up to being equal to the diameter of the diaphragm 17. As a result, the admissible power of the movable coil 18 is increased in proportion with the increase of its diameter. More precisely, a 20% increase of the diameter of the movable coil induces an equivalent gain in power handling.

Fourthly, as the moving part 16 is fixed inside the diaphragm 17, through the suspension 26 and the endoskeleton 20, the transducer 1 is free of a radially cumbersome external support. Due to the 100% emitting diaphragm 17, the ratio between the emitting surface and overall radial size (which is equal to the ratio of the squares of the radiuses of the diaphragm and transducer) is increased, up to about 70%.

Such ratio allows for making a short horn initial section 49 (measured axially), which permits the mounting of the transducer in an axial and frontal position within the low range transducer 57, with a tangential continuity between the horn initial section 49 and the diaphragm 61 of the low range transducer 57.

In addition, the absence of exoskeleton prevents thermal confinement of the magnetic circuit 2. This aspect, combined with the direct thermal contact between the yoke 4 and the waveguide 39, which is made of a good heat conducting material, allows for significant increase of the heat dissipating capacity of the transducer 1, and hence of its power handling.

As already explained, the transducer 1 is free of an external cumbersome support outside the diaphragm 17, since such support is achieved through the endoskeleton 20. This aspect, combined with the increased diameter of the movable coil 18, equal to the diameter of the diaphragm 17, allows for an increase of the diameter of the magnetic circuit 2, up to the overall diameter of the transducer 1, as depicted on FIG. 1.

This induces an increase of the BL product (i.e. the product of the magnetic field within the air gap 15 and the wire length of the solenoid 18, which is proportional to the Laplace force displacing the moving part 16), and hence a gain in transducer sensitivity (proportional to the square of the BL product increase). Practically, due to the endoskeleton type architecture of the transducer 1, an increase of the BL product by about 40% may be obtained, and hence a sensitivity gain up to about 3 dB.

The invention claimed is:

1. An electro-dynamic transducer including:

a main magnetic circuit defining an air gap, a moving part comprising a dome shaped diaphragm fixed to a movable coil diving into the air gap;

a support to which the moving part is suspended;

a suspension linking the moving part and the support;

wherein the support at least partly extends in an inner volume inside the moving part, wherein the suspension is fixed, by an outer periphery, to an inner face of the moving part, and wherein the suspension is made of an acoustically non emitting material, and wherein the suspension has in section a substantially polygonal shape and has an outer peripheral edge of frusto-conical shape through which the suspension is fixed to an inner face of the diaphragm.

2. The transducer according to claim 1, wherein the moving part comprises a coil support.

3. The transducer according to claim 1, wherein the moving part is free of a suspension outside of the moving part.

4. The transducer according to claim 1, wherein the support comprises a plate on which the suspension is fixed, and a rod fixed to the plate and through which the support is fixed to the magnetic circuit.

5. The transducer according to claim 4, wherein the suspension comprises a planar inner portion fixed to the plate, and a peripheral portion surrounding the inner portion and which freely extends with respect of the plate and is fixed to the moving part through the outer peripheral edge.

6. The transducer according to claim 1, wherein the support comprises a peripheral groove, and wherein the suspension, glued to the support, is under the form of a ring, an inner edge of which is received within the groove.

7. The transducer according to claim 4, further comprising an electrical circuit for supplying the movable coil, including two electrical conductors which cross the magnetic circuit and open in the inner volume inside the diaphragm.

8. The transducer according to claim 7, wherein the plate is provided with holes, and wherein stripped ends of the conductors are connected to a pair of eyes received within said holes.

9. The transducer according to claim 8, wherein the electrical circuit comprises two resilient conductors which extend inside the inner volume of the diaphragm and connect the eyes to an end of the movable coil.

10. The transducer according to claim 1, further comprising a waveguide mounted in the vicinity of the diaphragm and having a face facing and in the vicinity of the diaphragm and limiting a compression chamber.

11. A coaxial two-way or more loudspeaker system comprising a low range electro-dynamic transducer for the reproduction of low range and/or mid range frequencies, and an electro-dynamic transducer according to claim 1, for the reproduction of high range frequencies.

12. The system according to claim 11, wherein the high range transducer is mounted in a coaxial and frontal position with respect of the low range transducer.

13. A loudspeaker enclosure including a transducer according to claim 1.

14. A loudspeaker enclosure including a coaxial loudspeaker system according to claim 11.

15. A coaxial two-way or more loudspeaker system comprising a low range electro-dynamic transducer for the reproduction of low range and/or mid range frequencies, and an electro-dynamic transducer according to claim 1, for the reproduction of high range frequencies and at least part of the mid range.

16. An electro-dynamic transducer, comprising:

a main magnetic circuit defining an air gap;

a moving part comprising a dome shaped diaphragm fixed to a movable coil disposed in the air gap;

a support to which the moving part is coupled through a suspension;

wherein the suspension is fixed, at an outer periphery of the suspension, to an inner face of the moving part at a location spaced from where the dome shaped diaphragm is fixed to the movable coil, and wherein the suspension has in section a substantially polygonal shape and has an outer peripheral edge of frusto-conical shape through which the suspension is fixed to an inner face of the diaphragm.

17. The transducer according to claim 16, wherein the support at least partly extends within an inner volume defined by the moving part.

18. The transducer according to claim 16, wherein the suspension is made of an acoustically non emitting material.

* * * * *